US006666551B2

(12) United States Patent
Kobayashi et al.

(10) Patent No.: US 6,666,551 B2
(45) Date of Patent: Dec. 23, 2003

(54) INK CARTRIDGE

(75) Inventors: Takao Kobayashi, Nagano (JP); Hisashi Miyazawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/996,860

(22) Filed: Nov. 27, 2001

(65) Prior Publication Data

US 2002/0044184 A1 Apr. 18, 2002

Related U.S. Application Data

(63) Continuation of application No. 08/945,811, filed as application No. PCT/JP97/00470 on Feb. 20, 1997.

(51) Int. Cl.[7] ..... B41J 2/175
(52) U.S. Cl. ..... 347/86
(58) Field of Search ..... 347/84, 85, 86, 347/87; 101/202; 401/40

(56) References Cited

U.S. PATENT DOCUMENTS

| | | | | |
|---|---|---|---|---|
| 3,720,473 A | * | 3/1973 | Nakata | 401/40 |
| 3,972,547 A | | 8/1976 | Itoya | |
| 4,514,742 A | * | 4/1985 | Suga et al. | 347/85 |
| 4,677,447 A | | 6/1987 | Nielsen | |
| 4,700,202 A | | 10/1987 | Kuranishi et al. | |
| 4,827,280 A | | 5/1989 | Stamer et al. | |
| 4,893,138 A | | 1/1990 | Terasawa et al. | |
| 4,965,596 A | | 10/1990 | Nagoshi et al. | |
| 5,040,002 A | * | 8/1991 | Pollacek et al. | 347/87 |
| 5,244,092 A | | 9/1993 | Karita et al. | |
| 5,279,410 A | | 1/1994 | Arashima et al. | |
| 5,359,357 A | | 10/1994 | Takagi et al. | |
| 5,552,816 A | | 9/1996 | Oda et al. | |
| 5,631,682 A | | 5/1997 | Takata | |
| 5,657,058 A | | 8/1997 | Mochizuki et al. | |
| 5,666,146 A | | 9/1997 | Mochizuki et al. | |
| 5,790,157 A | | 8/1998 | Higuma et al. | |
| 5,886,721 A | | 3/1999 | Fujii et al. | |
| 6,000,788 A | | 12/1999 | Iida | |
| 6,192,797 B1 | * | 2/2001 | Rea et al. | 101/202 |
| 6,193,364 B1 | | 2/2001 | Iida | |
| 6,238,042 B1 | * | 5/2001 | Kobayashi et al. | 347/86 |
| 2001/0006396 A1 | | 7/2001 | Iida | |

FOREIGN PATENT DOCUMENTS

| | | |
|---|---|---|
| EP | 439 728 | 8/1991 |
| EP | 0 609 863 | 8/1994 |
| EP | 0 631 874 | 1/1995 |
| JP | 59-176545 | 11/1984 |
| JP | 2-198862 | 8/1990 |
| JP | 4-73158 | 3/1992 |
| JP | 5-345423 | 12/1993 |
| JP | 7-89087 | 4/1995 |
| JP | 7-195703 | 8/1995 |

* cited by examiner

*Primary Examiner*—Anh T. N. Vo
(74) *Attorney, Agent, or Firm*—Stroock & Stroock & Lavan LLP

(57) ABSTRACT

An ink cartridge may have an ink accommodating portion shaped to contain ink, an ink supply hole disposed at a bottom of the ink accommodating portion, and a valve unit including a movable valve portion and a fixed valve portion, the movable valve portion being oriented such that a flow of ink is regulated by a horizontal motion of the movable valve portion. The valve unit may further include a main portion and an auxiliary portion, the movable valve portion being disposed on the main portion and the fixed valve portion being disposed on the auxiliary portion, wherein the auxiliary portion is selectively detachable from the main portion. The ink cartridge may further comprise a supply hole attachment located at the bottom of the ink accommodating portion, the supply hole being defined in a selectively detachable supply hole attachment.

27 Claims, 15 Drawing Sheets

INK CARTRIDGE

CROSS-REFERENCE TO RELATED APPLICATIONS

This application is a continuation of application Ser. No. 08/945,811, filed Feb. 23, 1998, currently pending, which was the National Stage of International Application No. PCT/JP97/00470, filed Feb. 20, 1997.

BACKGROUND OF THE INVENTION

The present invention relates to a technical field of such as an ink cartridge for supplying ink to a printer head of a recording apparatus such as an ink-jet type printer, as well as an ink filling device for supplying ink to the interior of the ink cartridge.

Conventionally, with used ink cartridge of this type, from the viewpoint that if the used ink cartridges were discarded as such, resources would be wasted and environmental destruction would be promoted, it has been recommended to refill new ink to promote their reuse.

However, since a seal member of an ink supplying portion of the ink cartridge is generally broken by an ink supplying needle on the printer apparatus side during use, it has been difficult to reuse the ink cartridge unless regeneration processing is carried out.

With the ink cartridge is accordance with the above-described prior art, since it is necessary to completely peel off the broken seal member from the ink supplying portion for the purpose of the reuse of the ink cartridge, and it is necessary to attach an unused seal member and refill ink into the case, it has been considered very difficult for printer users who are able to carry out operations of merely replenishing ink to effect the regeneration processing of the used ink cartridges.

In addition, with ink cartridges of this type, in the case of unused ink cartridges at a time of supplying ink to the interior of foam for retaining the ink, it has been the general practice to automatically fill the ink through their ink injection holes as part of their assembly line, or in the case of refilling (refill-processing) ink into used ink cartridges, it has been the general practice to use an ink injecting tool shaped in the form of a syringe (prior art)

In addition, as in, for instance, Japanese Patent Application Laid-Open No. 17052/1995 (publicly known example), an ink supplying device has been disclosed in which a porous member impregnated with ink is wrapped in a film member and is inserted into a foam accommodating chamber, and when an openable cover is closed, the film member is adapted to break by an ink supplying port, making it possible to supply the ink.

With the above-described prior art, since the ink injection hole is used when ink is injected under pressure into the foam through an ink injecting portion, the ink filling time becomes prolonged, which resultantly constituted a factor for higher cost.

In addition, although the above-described publicly known example is excellent in that the ink fill-processing is simplified by making the insertion and withdrawal of the foam possible, the processing step for replacing the foam is added, so that the complication of the ink fill-processing is unavoidable.

A first object of the present invention is to provide an ink cartridge in which a supply hole means is connected to an ink accommodating means in such a manner as to be detachably fitted thereto and which has a simple structure and can withstand use over extended periods of time.

A second object of the present invention is to provide an ink cartridge which makes it possible not only for a manufacturer of the ink cartridge but also a user to easily effect the regeneration processing of a used ink cartridge.

A third object of the present invention is to provide an ink cartridge in which the ink supplying means of the ink cartridge is simply detachable and replaceable by means of the operator's fingers or by using a household tool such as pinchers and pliers.

A fourth object of the present invention is to make it possible to effect the regeneration processing of only the ink supplying portion removed from the ink cartridge, thereby making it possible to effect a substantial reduction in cost.

A fifth object of the present invention is to provide an ink cartridge which is capable of speedily and effectively filling ink with the foam filled in a foam chamber.

A sixth object of the present invention is to provide an ink cartridge which makes it possible to fill ink in a very short time by making opposite ends of the foam chamber in an open state.

A seventh object of the present invention is to provide an ink cartridge which makes it possible to simply remove upper and lower covers capable of closing the foam chamber from a cartridge frame member through retention and disengagement between engaging legs of the upper and lower covers and engaging projections provided on the cartridge frame member, thereby facilitating the ink filling operation.

An eighth object of the present invention is to provide an ink cartridge which in which an engaging cross section of a seal member is acute-angled to increase the amount of ink filled.

A ninth object of the present invention is to provide an ink cartridge which improves the sealing performance of a seal member provided with ribs on an upper cover.

A 10th object of the present invention is to provide an ink filling device and an ink filling method which are capable of supplying a large quantity of ink speedily from an open end of the foam chamber into the foam chamber.

An 11th object of the present invention is to provide an ink cartridge which is capable of effectively supplying ink by making use of a negative-pressure generating means.

DISCLOSURE OF THE INVENTION

The following are characteristic features in the configuration of the present invention for attaining the above objects.

1. An ink cartridge in a recording apparatus or the like which is capable of supplying ink to recording means, comprising: ink accommodating means capable of accommodating the ink in an interior thereof; and supply hole means capable of supplying the ink, wherein the supply hole means is detachably fitted to the ink accommodating means.

2. An ink cartridge in a recording apparatus or the like according to item 1, wherein the supply hole means is capable of being disassembled and assembled.

3. An ink cartridge in a recording apparatus or the like according to item 1 or 2, wherein the supply hole means comprises negative-pressure generating means.

4. An ink cartridge in a recording apparatus or the like according to item 1 or 2, wherein the supply hole means has a packing member and a seal member for sealing the supply hole provided on an outer side of the packing member.

5. An ink cartridge in a recording apparatus or the like according to item 1, 2, or 4, wherein the ink accommodating means has an ink-retaining porous member fitted therein.

6. An ink cartridge in a recording apparatus or the like wherein an upper cover having openable venting means and a lower cover having ink supplying means are respectively fitted detachably to one side of a cartridge frame member provided with a both-end open foam chamber and to another side thereof in such a manner as to seal the foam chamber.

7. An ink cartridge in a recording apparatus or the like according to item 6, wherein attaching and detaching means for fitting the upper cover and the lower cover to the cartridge frame member is arranged such that engaging legs provided projectingly on the upper cover and the lower cover are detachably retainable at engaging projections provided on the cartridge frame member.

8. An ink cartridge in a recording apparatus or the like according to item 6 or 7, wherein the seal members are provided between the upper cover and the cartridge frame member and between the lower cover and the cartridge frame member.

9. An ink cartridge in a recording apparatus or the like according to item 8, wherein a sealing engaging cross section of the seal member is acute-angled.

10. An ink cartridge in a recording apparatus or the like according to item 6, wherein a rib whose height varies and whose central portion is highest is provided on an inner surface of the upper cover.

11. An ink cartridge in a recording apparatus or the like according to item 6, 7, or 8, wherein a plurality of foam chambers are independently juxtaposed in the cartridge frame member, the upper cover formed as one unit and the lower cover formed as one unit for hermetically closing the foam chambers are detachably fitted to the cartridge frame member.

12. An ink filling device capable of supplying ink to an interior of a cartridge frame member of the ink cartridge, wherein a plurality of ink supplying/discharging tools capable of hermetically abutting against open ends of a foam chamber filled with foam are respectively provided with ink circulating chambers and engaging seal members provided with ink through holes for supplying the ink to the foam, and ink supplying sections for supplying the ink to the ink circulating chambers are respectively connected to the ink circulating chambers.

13. An ink filling device according to item 12, wherein the ink circulating chambers are selectively communicably connected to the ink supplying sections and ink recovering sections via changeover valves, respectively.

14. An ink filling method for supplying ink to an ink cartridge, comprising the steps (1) to (4):

(1) causing ink supplying/discharging tools to hermetically abut against open opposite ends of a cartridge frame member filled with foam;

(2) causing the ink supplied from one of ink supplying sections to be supplied reversibly to a foam chamber through ink through holes provided in seal members respectively attached to outer ends of ink circulating chambers;

(3) disengaging the ink supplying/discharging tools from the cartridge frame member, and (4) fitting the covers to the cartridge frame member in such a manner as to seal the foam chamber by means of the upper cover and the lower cover.

15. An ink filling method according to item 14, wherein the ink is supplied after the upper cover and the lower cover are removed from the cartridge frame member of used the ink cartridge.

16. An ink cartridge in a recording apparatus or the like according to item 3, wherein the negative-pressure generating means includes a movable-valve portion and a fixed-valve portion.

17. An ink cartridge in a recording apparatus or the like according to item 1, 2, 3, 4, or 16, wherein fitting means for detachably fitting the supply hole means to the ink accommodating means is fitting means selected from among screw means, snap-fit type attaching/detaching means, and press-fitting means.

In terms of the operation, as will be described in detail in the section on the best mode for carrying out the invention, the ink accommodating means constituting a part of the ink cartridge and the supply hole means for supplying the ink can be easily detachably fitted to each other without requiring a special tool or the like. In addition, the ink supplying means can be disassembled, and the negative-pressure generating means is provided to ensure efficient supply of ink.

BEST MODE FOR CARRYING OUT THE INVENTION

To give a more detailed description of the present invention, a description will be given with reference to the accompanying drawings.

A point which is common to the respective embodiments is that a supply hole case in an ink supplying portion of an ink cartridge is made detachable and replaceable.

First Embodiment (1) Configuration

Figure 1:
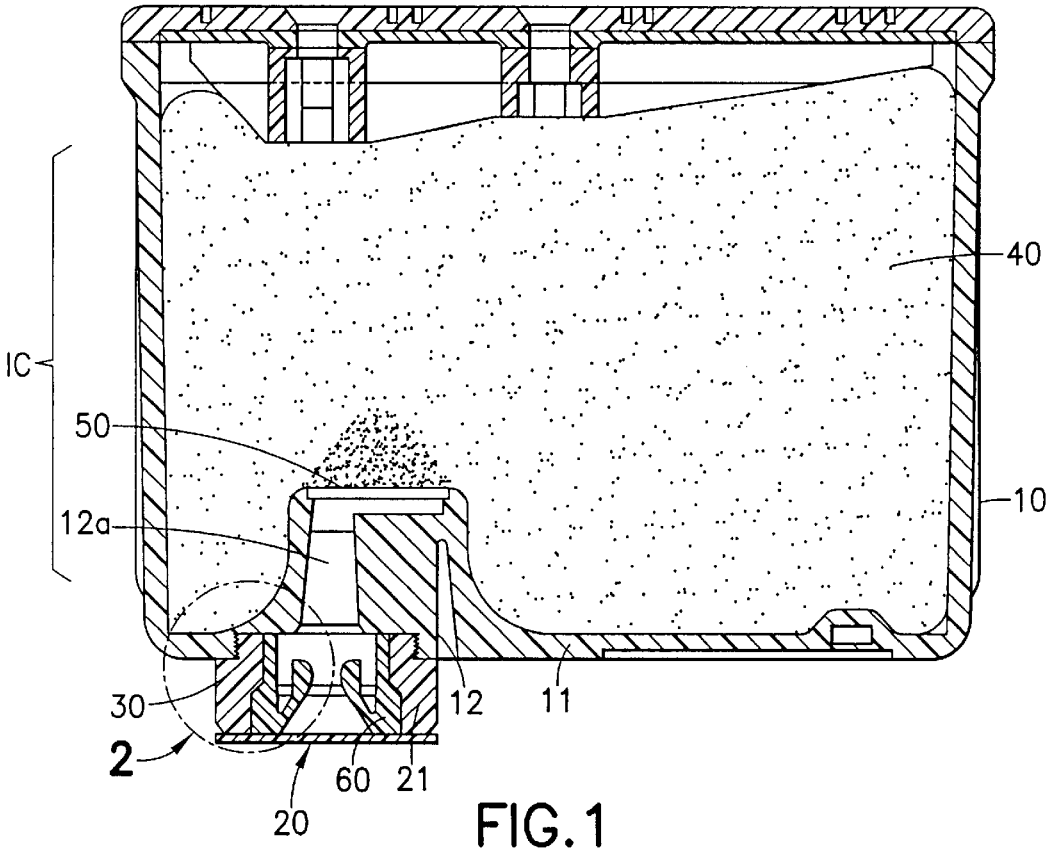
FIG. 1 is a vertical cross-sectional view of an ink cartridge in accordance with a first embodiment.
Figure 2:
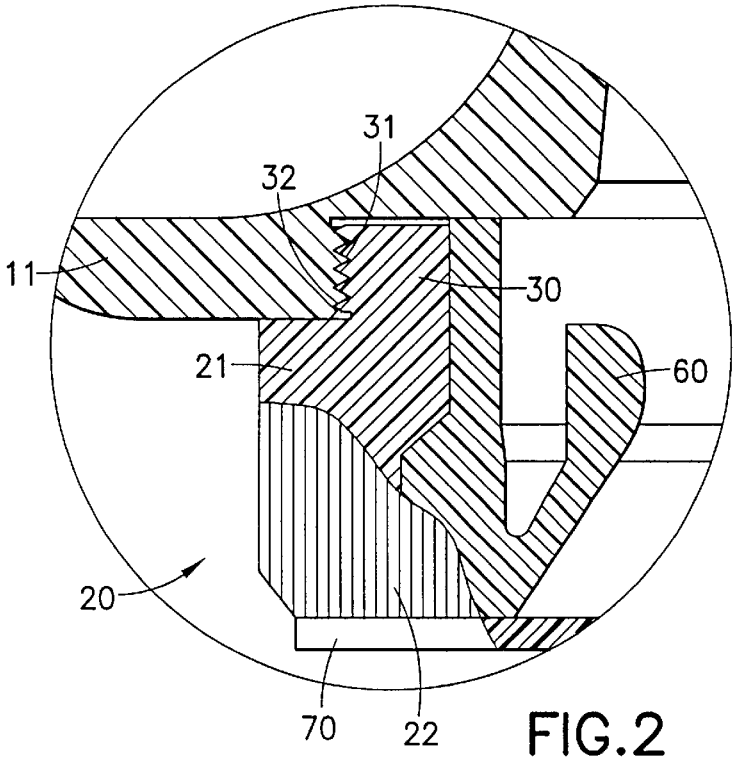
FIG. 2 is an enlarged vertical cross-sectional view of an essential portion surrounded by a circle in FIG. 1.

An ink cartridge in accordance with a first embodiment shown in FIGS. 1 and 2 is arranged such that a supply hole attachment 20 is threadedly fitted detachably to a case 10 of an ink cartridge IC by means of a screw means 30. An inwardly projecting ink supplying portion 12 is integrally formed at a bottom portion 11 of the case 10 of the ink cartridge IC formed by molding a hard plastic material, and a filter 50 which abuts against a porous member 40 is attached to a top portion thereof.

In addition, an internal thread 31 having a large diameter and continuing to an ink hole 12*a* of the ink supplying portion 12 is formed in the bottom portion 11.

On the other hand, a packing member 60 is hermetically fitted in a supply hole case 21 of the supply hole attachment 20, and an external thread 32 of the screw means 30 provided on the supply hole case 21 is threadedly secured to the internal thread 31 provided in the bottom portion 11 of the case 10, so as to be aligned with the ink hole 12*a*.

In addition, as shown in FIG. 2, a knurled portion 22, which performs the function of preventing slippage during its threaded securing, is formed around an outer periphery of the supply case 21. However, it goes without saying that, as the slippage preventing means, it suffices if the shape is made capable of effectively imparting torque to the supply case 21, such as by matte-finishing the outer periphery of the supply hole case 21, or by adopting different diameters, or by forming a finger-engaging recessed/projecting portion.

Incidentally, reference numeral 70 in the drawing denotes a seal member for sealing the supply hole case 21 and the packing member 60.

(2) Method of Use

The ink cartridge IC shown in FIG. 1 is installed in a printer (not shown) during use, and is adapted to supply ink accommodated in the porous member 40 to the printer by making use of an ink leading-out tool (not shown) which enters the interior by piercing the seal member 70.

Accordingly, in the case of an used ink cartridge IC, the seal member 70 is broken.

In this state, by using his or her fingers or an arbitrary wrenching tool, an operator loosens the screw means 30 by imparting torque to the knurled portion 22, and removes the supply hole case 21 together with the packing member from the bottom portion 11 of the case 10. The user then threadedly secures newly the supply hole attachment 20 having an unused seal member 70 to the case 10 by means of the screw means 30, and replenishes new ink into the porous member 40, thereby making it possible to reuse the ink cartridge IC.

Incidentally, it goes without saying that the ink cartridge IC can be reused by replacing the broken seal member 70 of the used supply hole attachment 20 with a new one.

Second Embodiment (1) Configuration

Figure 3:
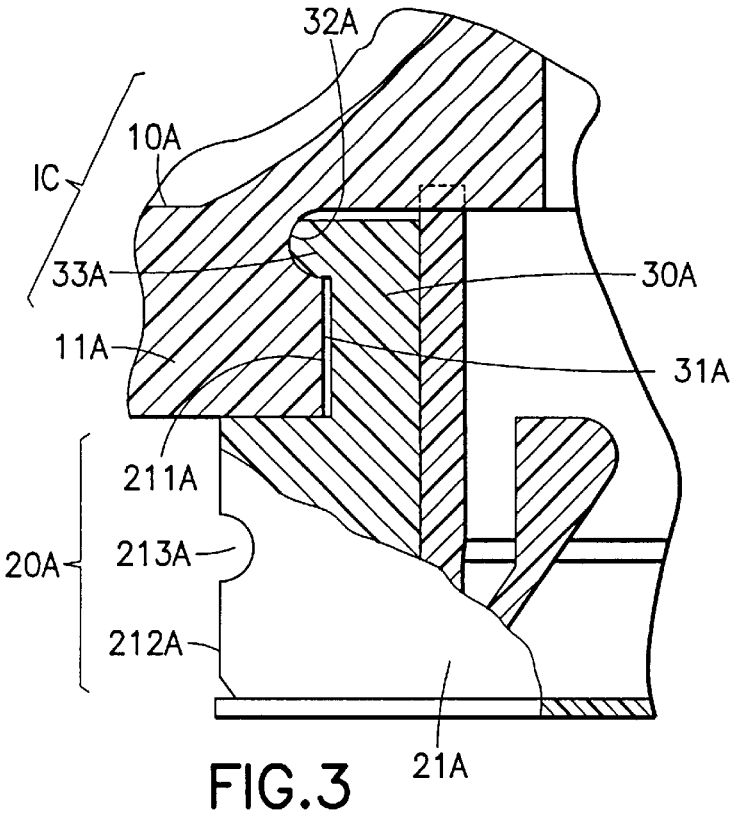
FIG. 3 is an enlarged vertical cross-sectional view of a second embodiment.

An ink cartridge in accordance with a second embodiment shown in FIG. 3 is arranged such that a supply hole attachment 20A is detachably fitted to a case 10A of the ink cartridge IC by means of a so-called snap-fit type attaching/detaching means 30A. Hereafter, a description will be given of its configuration, centering on portions that differ from those of the first embodiment.

Namely, as shown in enlarged form in FIG. 3, an engaging hole 31A for the attaching/detaching means 30A and an enlarged hole 32A continuing to the engaging hole 31A are formed in a bottom portion 11A of the case 10A. At the same time, a protrusion 33A which is press-fitted and engaged in the enlarged hole 32A is formed around an outer end of a reduced-diameter portion 211A of a supply hole case 21A of the supply hole attachment 20A.

In addition, a plurality of engaging holes 213A are formed around an outer periphery of a large-diameter portion 212A of the supply hole case 21A.

The other arrangements which are omitted in the above description are common to those of the first embodiment.

(2) Method of Use

When replacing the supply hole attachment 20A in the ink cartridge IC in the second embodiment, if, for example, an arbitrary pulling-out tool (not shown) is securely engaged in the engaging holes 213A and is forced in such a way as to pull out the supply hole attachment 20A from the case 10A, the protrusion 33A of the supply hole case 21A is deformed in a somewhat reduced-diameter state and is pulled out from the enlarged hole 32A, thereby allowing the supply hole attachment 20A to be disengaged from the case 10A. On the other hand, when refitting the supply hole attachment 20A, it suffices if the protrusion 33A is forcibly press-fitted into the enlarged hole 32A.

Incidentally, the other portions which are omitted concerning the method of its use are common to those of the first embodiment.

Third Embodiment (1) Configuration

Figure 4:
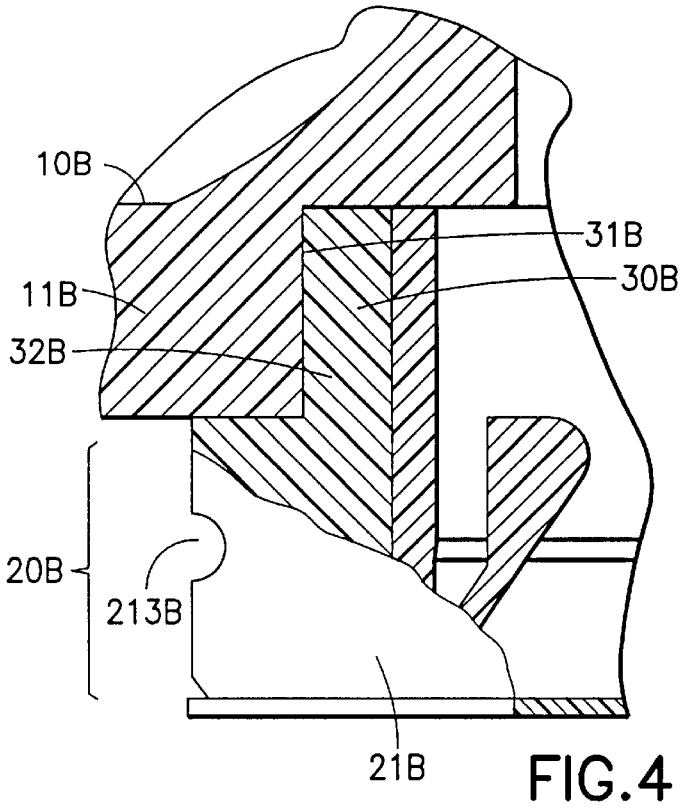
FIG. 4 is an enlarged vertical cross-sectional view of a third embodiment.
Figure 5:
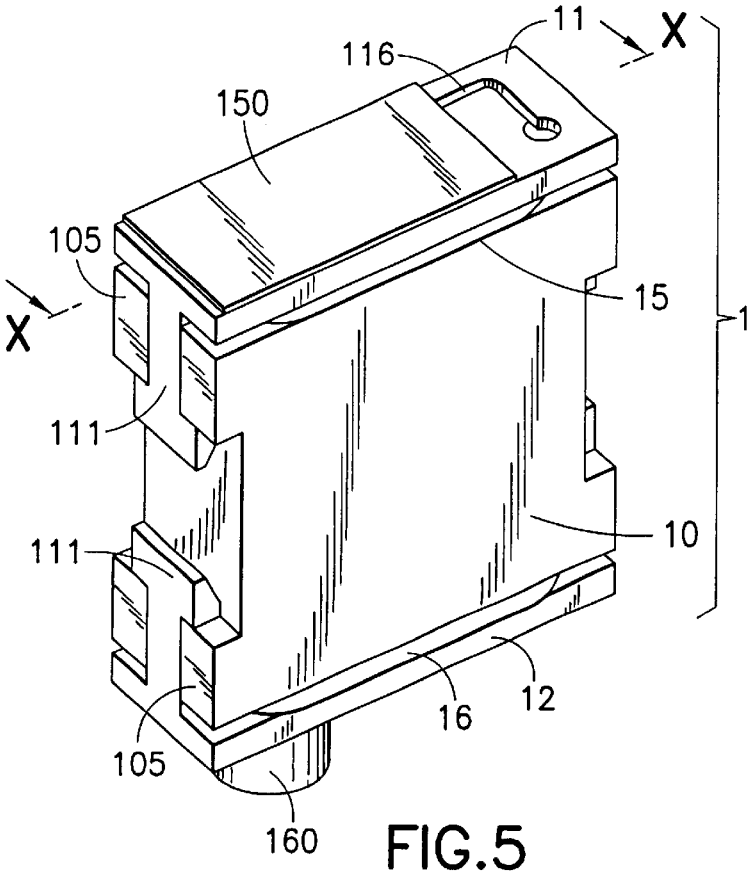
FIG. 5 is a perspective view, overlooking from above, of the ink cartridge in accordance with a fourth embodiment.
Figure 6:
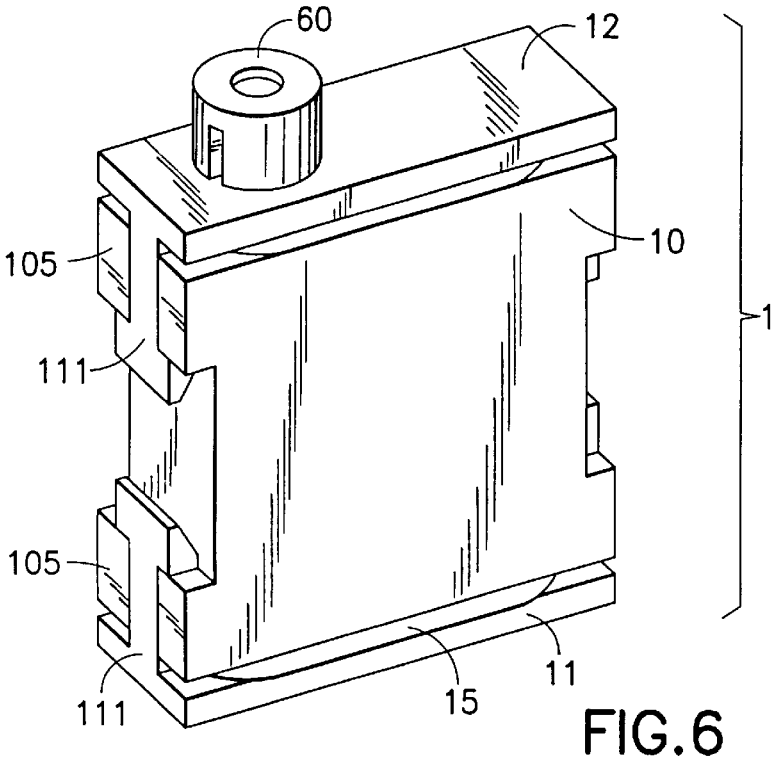
FIG. 6 is a perspective view, overlooking from below, of FIG. 5.
Figure 7:
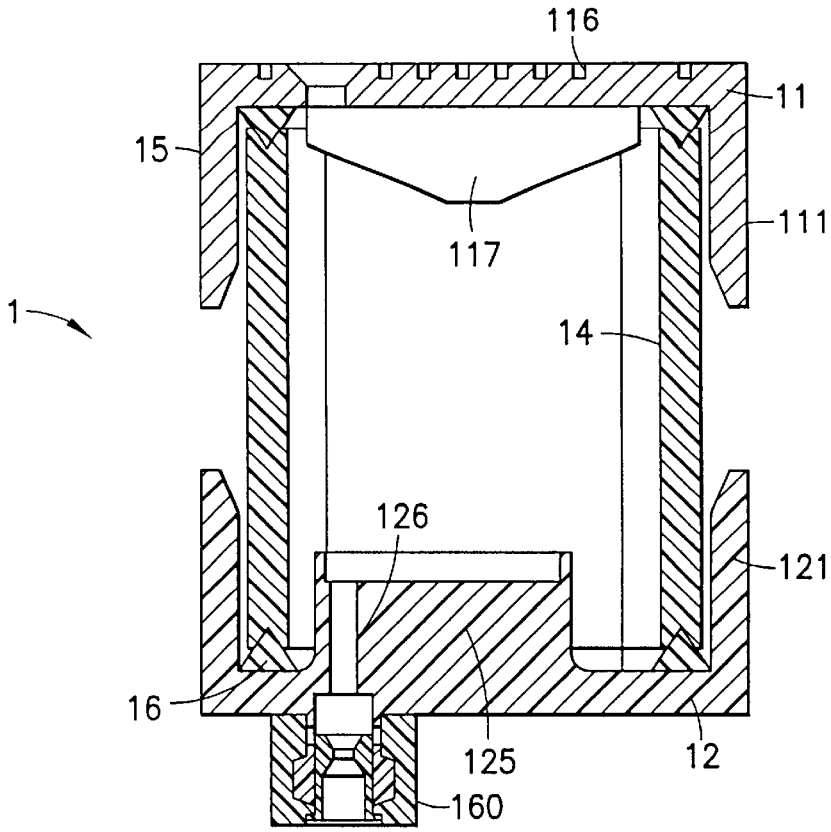
FIG. 7 is a cross-sectional view taken along line X—X in FIG. 5.
Figure 8:
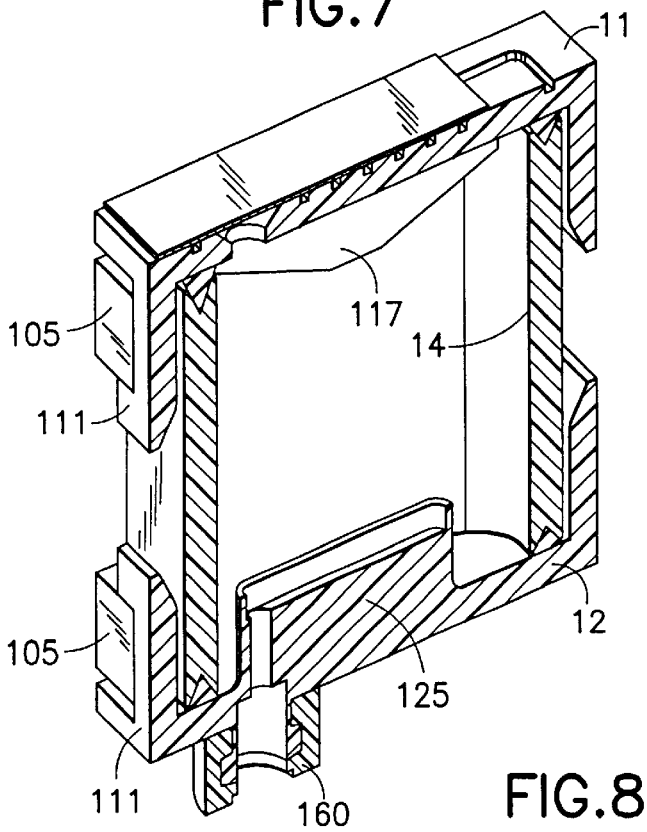
FIG. 8 is a perspective cross-sectional view taken along line X—X in FIG. 5.

An ink cartridge in accordance with a third embodiment shown in FIG. 4 is arranged such that a case 10B of the ink cartridge IC and a supply hole attachment 20B are detachably fitted by means of a press-fitting means 30B.

Namely, an attaching/detaching hole 31B is formed in a bottom portion 11B of the case 10B, and the dimension of the outside diameter of a reduced-diameter portion 32B of the supply attachment 20B is made slightly larger than the diameter of the attaching/detaching hole 31B, the reduced-diameter portion 32B being preferably formed in a tapered shape.

Incidentally, as the material of the case 10B or the supply hole case 21B, it is preferable to select a somewhat resiliently deformable hard plastic.

(2) Method of Use

To effect the attachment or detachment of the supply hole attachment 20B in the ink cartridge IC in accordance with the third embodiment with respect to the case 10B, it suffices if the supply hole attachment 20B is fitted by imparting a pressing force thereto, or if a required tool is retained at engaging holes 213B and the supply hole attachment 20B is pulled out and disengaged. Since the other aspects are common to those of the first or second embodiment, a redundant description thereof will be omitted.

Referring next to the drawings, a description will be given of embodiments of the ink cartridge and an ink filling device in accordance with the present invention.

Fourth Embodiment (1) Structure

An ink cartridge 1 shown in FIGS. 5 to 10 is of a type which is capable of accommodating a monochromatic ink. The ink cartridge 1 is structured such that an upper cover 11 and a lower cover which are detachable are respectively provided on a top portion and a bottom portion of a cartridge frame member 10 formed in the shape of a hollow rectangular parallelepiped box in terms of the shape of its external appearance, and a foam chamber 14 which is filled with foam 170 (see FIG. 12) is formed in its interior. Annular grooves 103 and 104 having V-shaped sections are respectively provided on a top surface 101 and a bottom surface 102 of the cartridge frame member 10. An upper seal member 15 and a lower seal member 16, which are annular and whose engaging sections are acute-angled, are respectively fitted in the annular grooves 103 and 104. The upper cover 11 and the lower cover 12 are made to hermetically abut against the cartridge frame member 10 in such a manner as to cover the respective upper and lower seal members 15 and 16. The arrangement provided is such that a narrow portion 112 of each of a pair of engaging legs 111, which are respectively juxtaposed at opposite ends of the upper cover 11, is inserted and fitted in an engaging groove 106 formed between a pair of retaining projections 105 provided projectingly on each of two side surfaces of the cartridge frame member 10, and a wide portion 113 continuing to the narrow portion 112 of the engaging leg 111 is retained at retaining surfaces 107 of the pair of retaining projections 105. A tapered portion 114 of the wide portion 113 is formed to aid the smooth passage of the wide portion 113 of the engaging leg 111 along top surfaces 108 of the pair of retaining projections 105 when the upper cover 11 is fitted and retained at the cartridge frame member 10. Here, since engaging sections of the upper and lower seal members 15 and 16 and the annular grooves 103 and 104 are made acute-angled, the wall of the foam chamber can be made thin, which makes it possible to make the cartridge compact or enlarge the ink-accommodating capacity of the foam chamber 14. This advantage becomes more noticeable particularly in a case where a plurality of foam chambers are formed as a unit.

It should be noted that, with respect to the lower cover 12 as well, the means for fitting and retaining the lower cover 12 at the cartridge frame member 10 is common to the upper cover 11, and is comprised of retaining legs 121, narrow portions 122, wide portions 123, and tapered portions 124, and in terms of its functions as well, there are especially no differences.

In addition, a vent hole 115 is formed in the upper cover 11, and a meandering air-releasing channel 116 continuing to the vent hole 115 is also formed therein. A re-releasable film 150 is attached to an outer surface of the upper cover 11, and a pair of ribs 117 for pressurizing the foam 170 and preventing the deformation of the upper surface is provided on an inner surface of the upper cover 11. Since the ribs 117 have varying height and are shaped such that their central portions are highest, the foam 170 is compressed, and not only can a venting space be secured, but also the rigidity of the upper cover 11 can be enhanced. As a result, it is possible to prevent a situation in which the compressive force of the upper seal member 15 itself declines in the vicinity of its center due to a reaction force of the upper seal member 15, consequently impairing its sealing characteristic.

Incidentally, as for the ribs 117, it goes without saying that even if their thickness is made large, it is possible to expect a similar sealing effect.

In addition, an internal supply port 125 is provided projectingly on the lower cover 12, and a supply attachment 160 is fitted to its outer cylinder 126 via a connecting seal 127. The function of making it possible to prevent the deformation of the lower cover 12 can be provided depending on the size and shape of the internal supply port 125.

(2) Methods of Disassembly and Assembly

Figure 9:
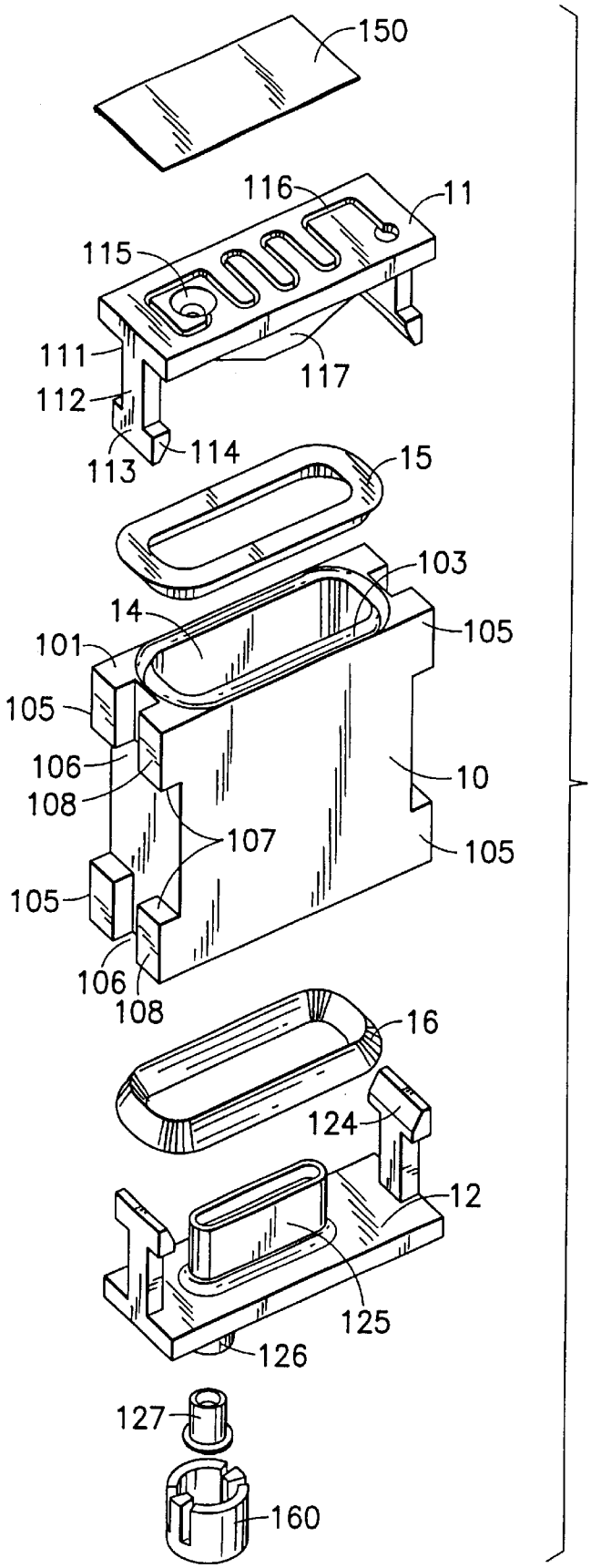
FIG. 9 is an assembly view, overlooking from above, of FIG. 5.
Figure 10:
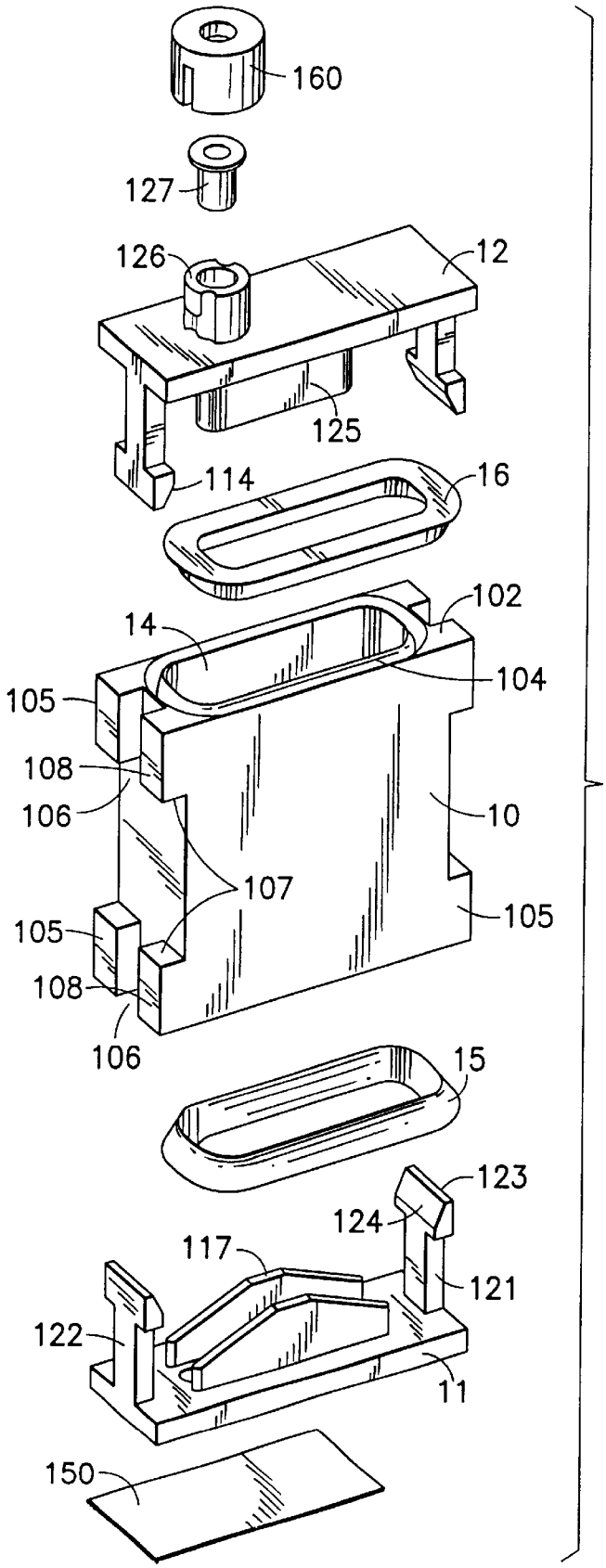
FIG. 10 is an assembly view, overlooking from below, of FIG. 5.

All the component members are arranged as shown in FIGS. 9 and 10, and the foam 170 is filled in the foam chamber 14 of the cartridge frame member 10. The upper and lower seal members 15 and 16 are respectively inserted and fitted in the annular grooves 103 and 104, and if the upper cover 11 facing downward and the lower cover 12 facing upward are engaged with the cartridge frame member 10 and are strongly pressed, the tapered portions 114 and 124 of the wide portions 113 and 123 of the engaging legs 111 and 121 ride over the top surfaces 108 of the engaging projections 105, and the wide portions 113 and 123 pass the top surfaces 108 in a state in which the narrow portions 112 and 122 are somewhat deflected outwardly. Then, the engaging legs 111 and 121 are urged inwardly by the returning forces of the narrow portions 112 and 122, the narrow portions 112 and 122 are inserted in the engaging grooves 106, the wide portions 113 and 123 are set in a state of being retained at the retaining surfaces 107. At this time, since the upper and lower seal members 15 and 16 are engaged in the annular grooves 103 and 104 in a state of being compressed, though slightly, by the upper and lower covers 11 and 12, the upper and lower covers 11 and 12 are hermetically retained by both surfaces of the cartridge frame member 10. Thus the assembly of the ink cartridge 1 is completed.

In addition, when disassembling the ink cartridge 1, the engaging legs 111 and 121 are slightly bent outwardly by the operator's fingers or a handy too, such as a screwdriver, the wide portions 113 and 123 are disengaged from the engaging projections 105 of the cartridge frame member 10, and the upper and lower covers 11 and 12 are urged in such a manner as to be pulled out from the cartridge frame member 10, thereby making it possible to disassemble the ink cartridge 1. Hence, it is possible to fill the foam 170 with ink, or effect cleaning and other maintenance and inspection.

Fifth Embodiment (1) Configuration

Figure 11:
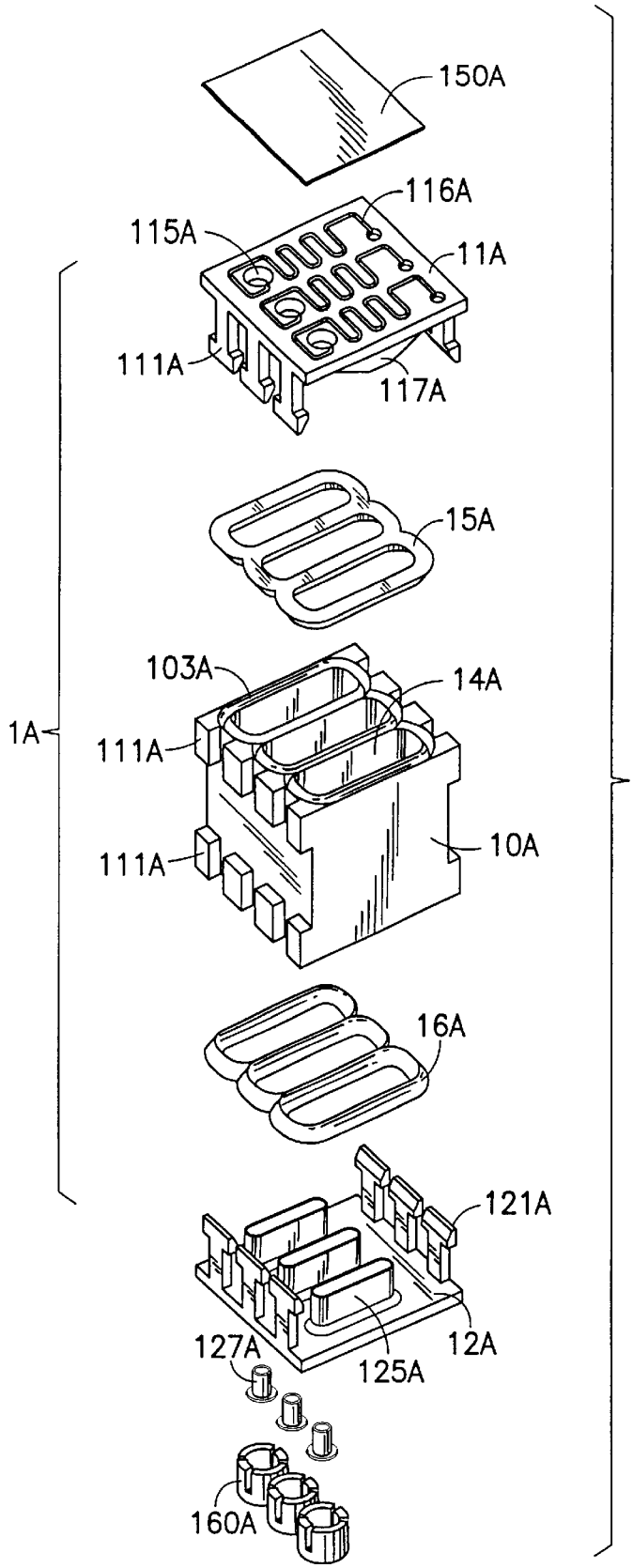
FIG. 11 is a perspective view, overlooking from above, of the ink cartridge in accordance with a fifth embodiment.

FIG. 11 shows a fifth embodiment of an ink cartridge 1A capable of independently accommodating inks of a multiplicity of colors. In terms of its characteristic configuration, a plurality of foam chambers 14A are juxtaposed adjacent to each other inside a cartridge frame member 10A, and annular grooves 103A and 104A, into which three-series upper and lower seal members 15A and 16A can be inserted and fitted and which have the same shape as the upper and lower seal members 15A and 16A, are respectively formed in a top surface and a bottom surface of the cartridge frame member 10A. A plurality of pairs of engaging legs 111A are provided on an upper cover 11A in an upper surface of which a plurality of vent holes 115A and air-releasing channels 116A are formed and to the upper surface of which a film 150A can be attached. Similarly, a plurality of pairs of engaging legs 121A are provided on a lower cover 12A as well, and internal supply ports 125A are also juxtaposed in the same number on the lower cover 12A.

Incidentally, those points a description of which is omitted in the fifth embodiment and whose arrangements are common to those of the third embodiment are illustrated by appending reference character (A) thereto.

(2) Methods of Disassembly and Assembly

Since the methods of disassembly and assembly are common to those in the case of the fourth embodiment in the procedure and functions, a description thereof will be omitted.

Sixth Embodiment (1) Configuration

Figure 12:
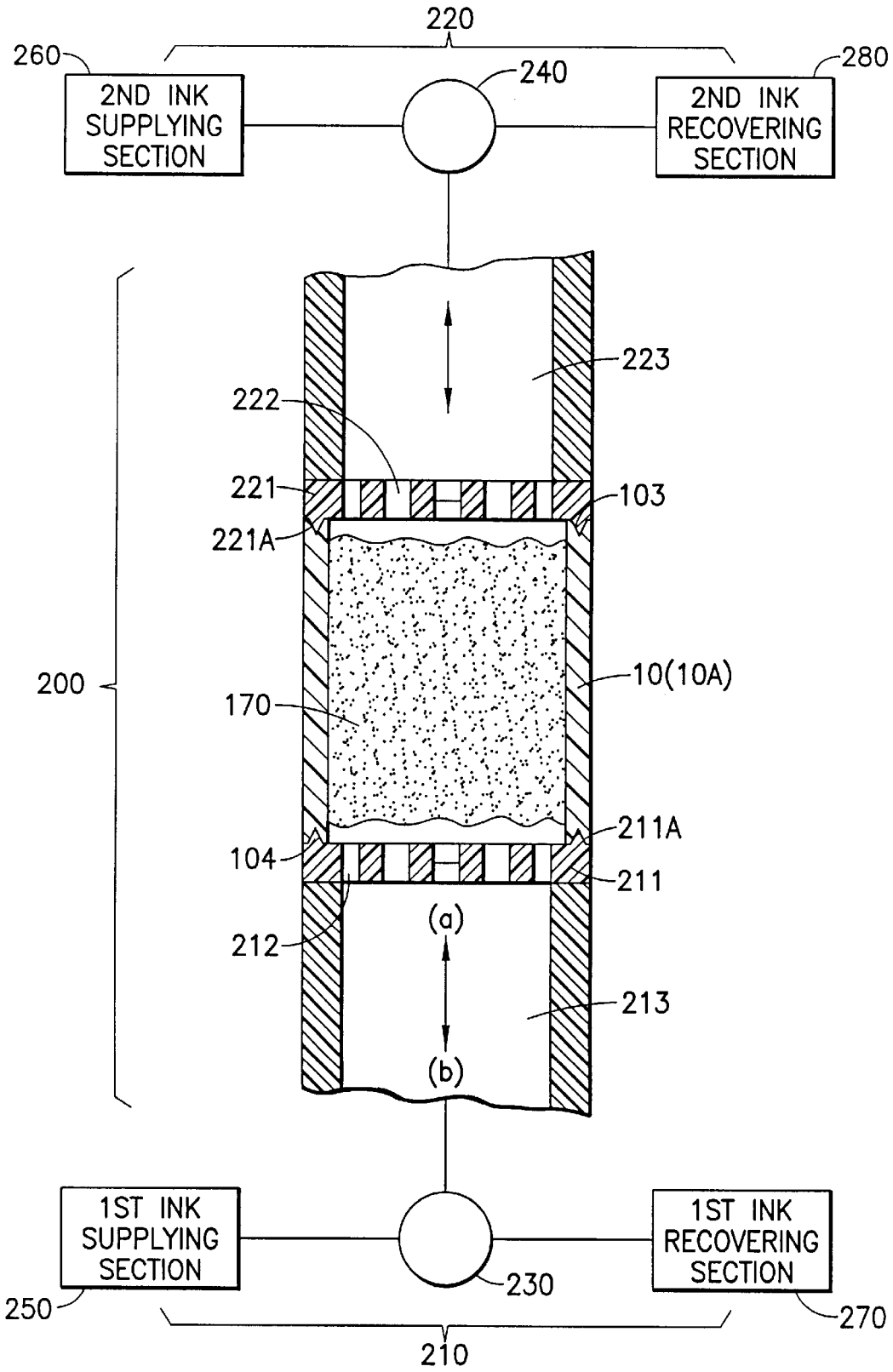
FIG. 12 is an explanatory block diagram of an ink filling device in accordance with a sixth embodiment.
Figure 13:
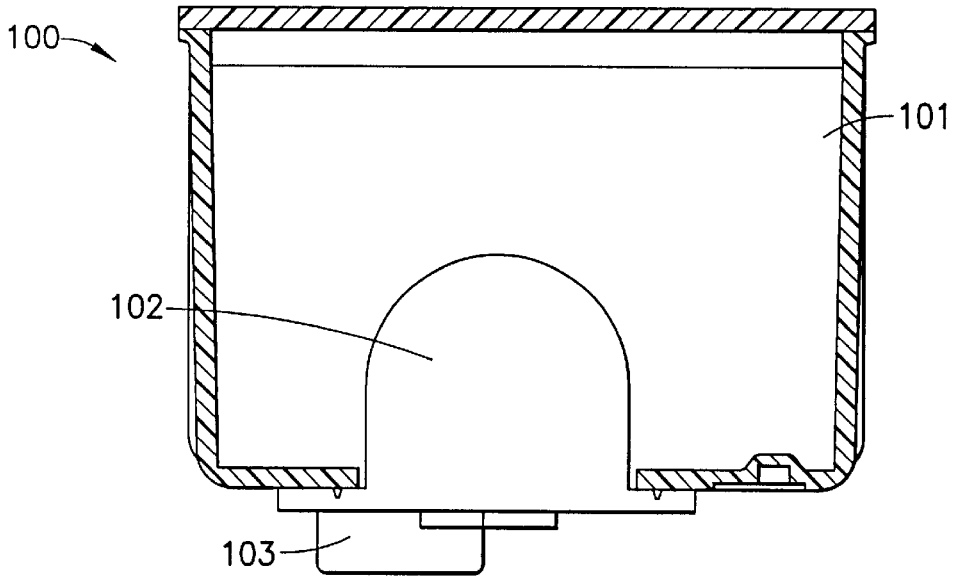
FIG. 13 is a vertical side cross-sectional view of the ink cartridge in accordance with a seventh embodiment.
Figure 14:
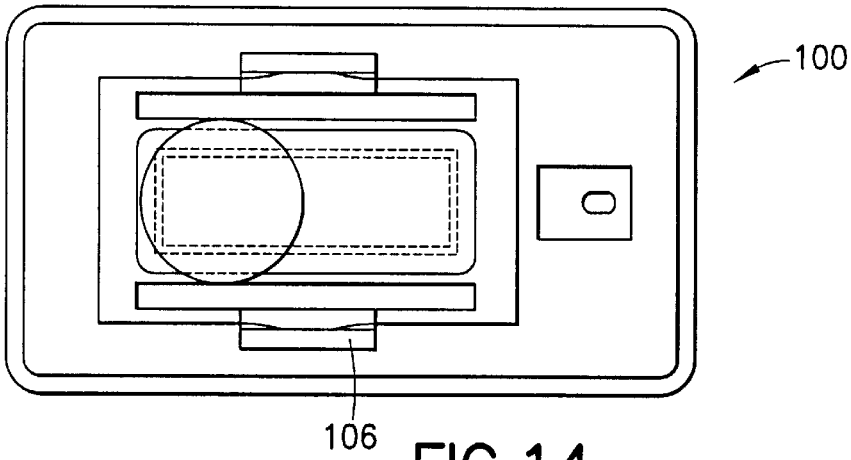
FIG. 14 is a bottom view of the ink cartridge in accordance with the seventh embodiment.

The device in accordance with a sixth embodiment shown in FIG. 12 is an ink filling device 200 for pouring ink into the ink cartridge 1 (or 1A). A set of first and second ink supplying/discharging tools 210 and 220 are arranged such that their respective engaging seal members 211 and 221 are provided with ink through holes 212 and 222, and their respective ink circulating chambers 213 and 223 are connected to first and second ink supplying sections 20 and 260 as well as first and second ink recovering sections 270 and 280 via first and second changeover valves 230 and 240, respectively.

(2) Method of Use

In a state in which the upper and lower covers 11 and 12 and the upper and lower seal members 15 and 16 are separated from the iii 10 as shown in FIG. 9, in order to effect the filling (or refilling) processing of ink into the foam 170 inserted in the foam chamber 14, protrusions 211A and 221A of the engaging seal members 211 and 221 are respectively made to engage with the annular grooves 104 as shown in FIG. 9, and an arrangement is provided in such a manner as to clamp the cartridge frame member 10 by the first and second ink supplying/discharging tools 210 and 220.

In this state, if the first and second changeover valves 230 and 240 are operated to supply unused ink from the first ink supplying section 250 on the first ink supplying/discharging tool 210 side and to cause the excess ink to be recovered into the ink recovering section 280 on the second ink supplying/discharging tool 220 side, the ink is circulated as indicated by arrow (a), thereby making it possible to fill the interior of the foam 170 with the ink.

It should be noted that if the circulating direction of the ink is intermittently changed and the ink is circulated inside the foam 170 reversibly in the directions of (a) and (b), it becomes possible to effect the cleaning processing of the foam 170 contaminated with dust and the like, and the recovered ink can be discharged into the first and second ink recovering sections 270 and 280.

The characteristic point of an embodiment shown below lies in a cartridge of the type in which the foam is not filled in the ink cartridge.

Seventh Embodiment

Figure 16:
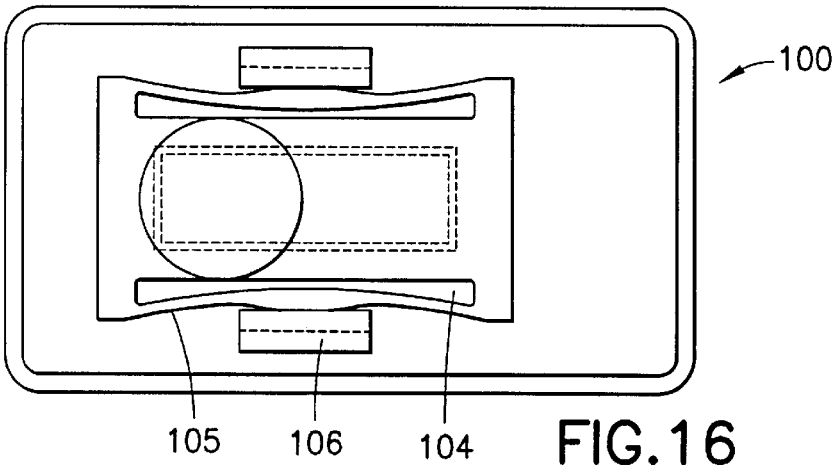
FIG. 16 is a bottom view during fitting in FIG. 14.
Figure 15:
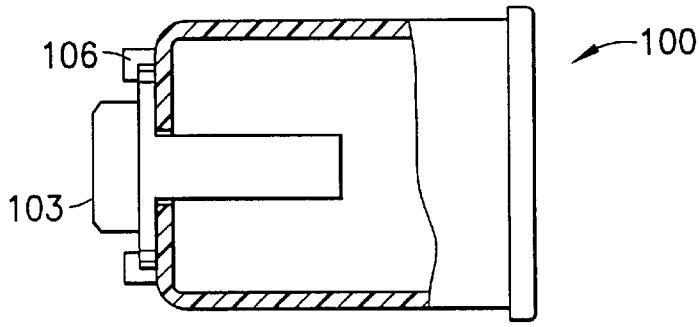
FIG. 15 is a vertical front cross-sectional view of the ink cartridge in accordance with the seventh embodiment.
Figure 17:
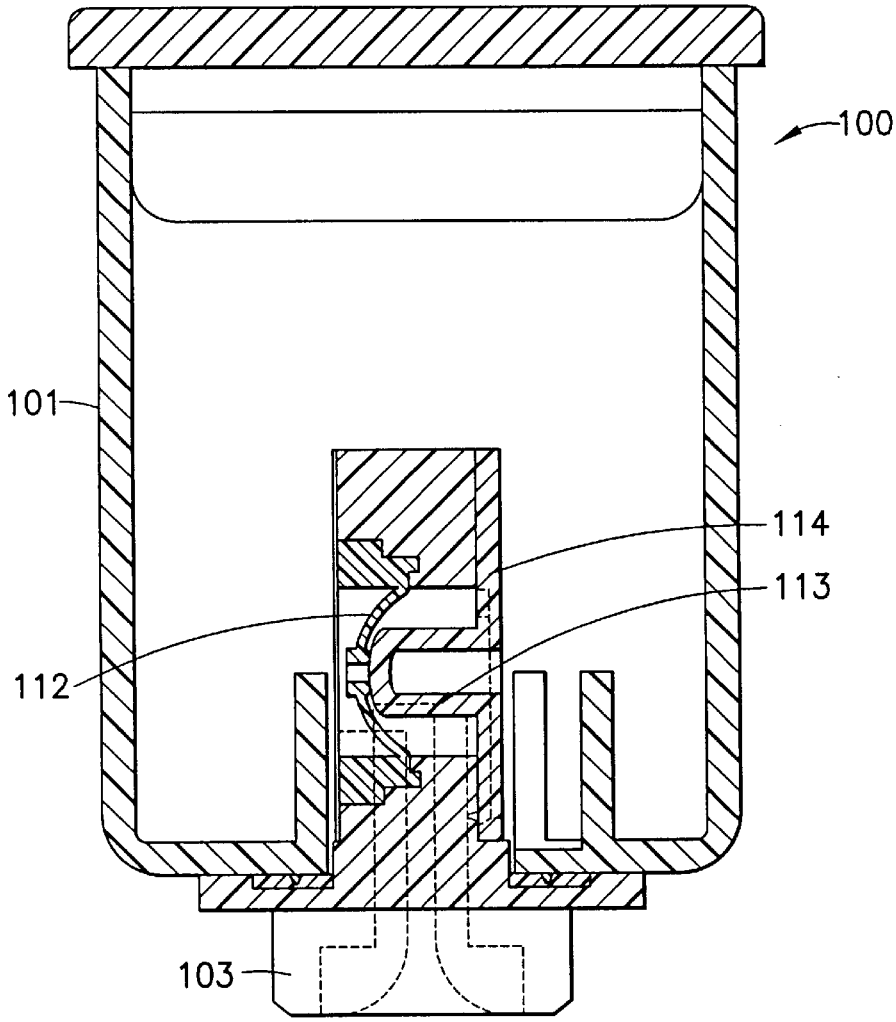
FIG. 17 is a vertical front cross-sectional view of the ink cartridge in accordance with the seventh embodiment.
Figure 18:
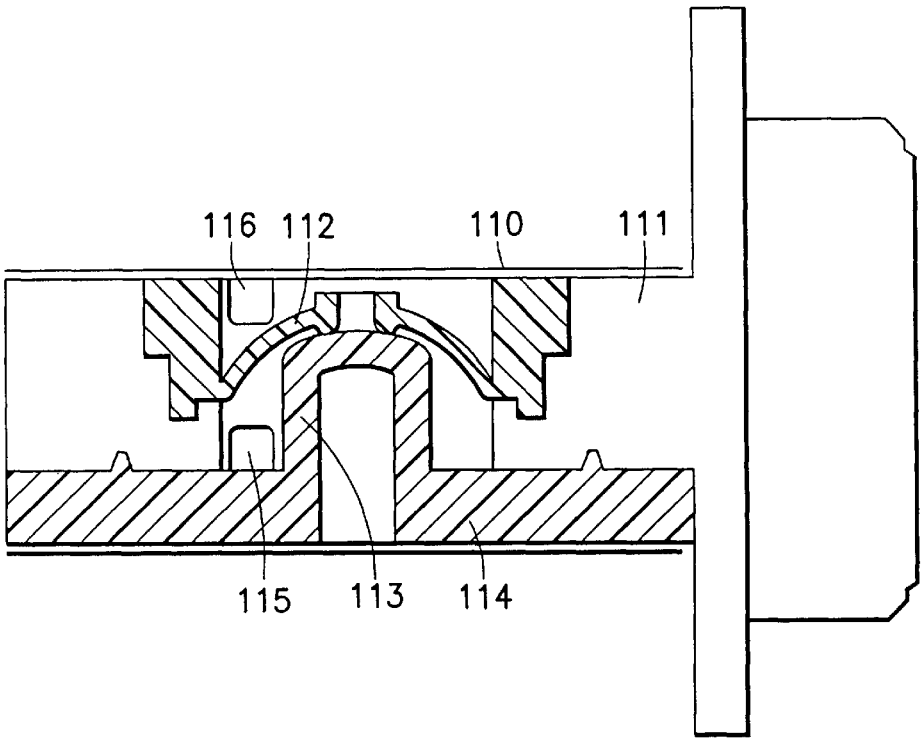
FIG. 18 is an enlarged cross-sectional view of a supply hole attachment in accordance with the seventh embodiment.

FIGS. 13 to 16 show an ink cartridge 100 in which a supply hole attachment 103 having a negative-pressure generating portion 102 is detachably provided in the bottom portion of an ink accommodating portion 101. As shown in FIG. 16, a pair of flexible portions 105 formed via a pair of slots 104 are respectively pressed to be fitted to a pair of snap-fitting portions 106 as shown in FIG. 16, thereby allowing the supply hole attachment 103 to be connected to the ink accommodating portion 101.

Figure 19:
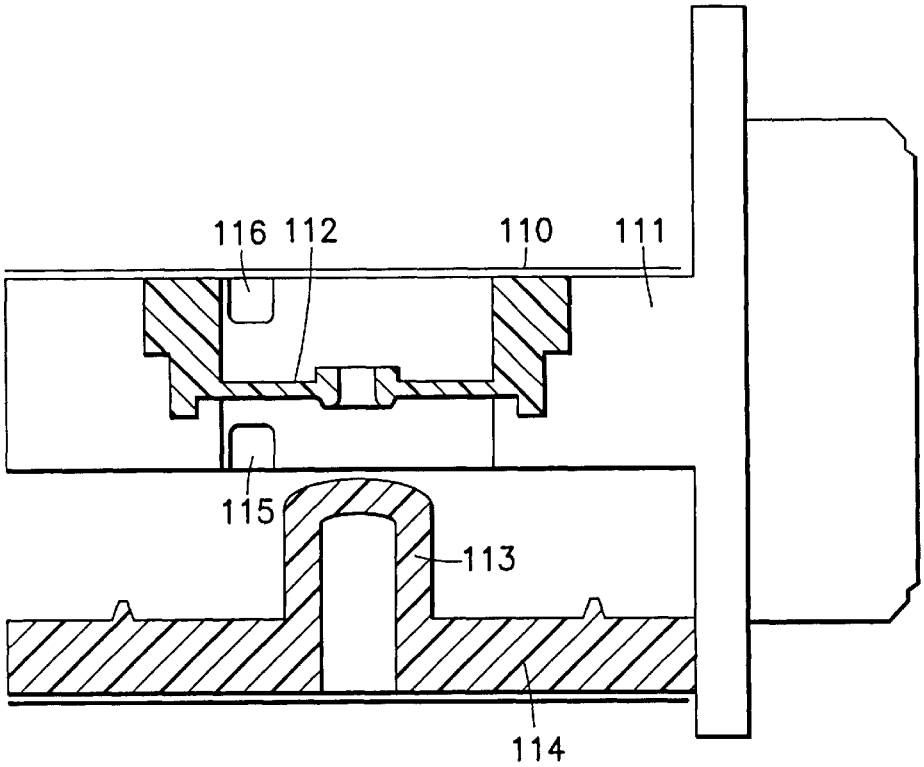
FIG. 19 is an explanatory exploded view of FIG. 18.

In addition, as for the configuration of the aforementioned negative-pressure generating portion 102, as shown in FIGS. 17 to 20, the negative-pressure generating portion 102 can be disassembled and reassembled, and is arranged such that a movable-valve portion 112 is disposed on a main portion 111 with a film 110 attached thereto, and a fixed-valve portion 113 opposing the movable-valve portion 112 is provided projectingly on an auxiliary portion 114 which is separable with respect to the main portion 111 to form an ink inlet-side channel 115 and an ink outlet-side channel 116. Thus, the negative-pressure generating portion 102 is arranged to be capable of being disassembled as shown in FIG. 19.

Figure 20:
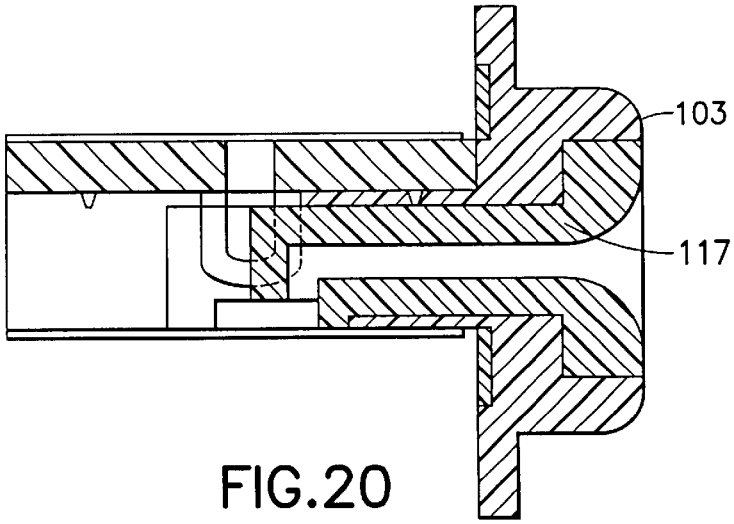
FIG. 20 is a cross-sectional view illustrating a connecting seal portion of FIG. 18.
Figure 21:
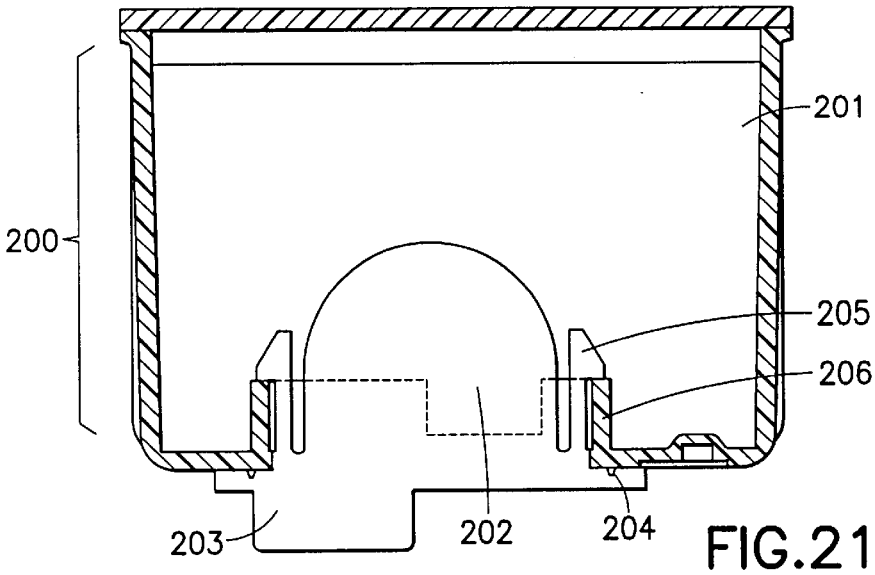
FIG. 21 is a vertical side cross-sectional view of the ink cartridge in accordance with an eighth embodiment.

Further, as shown in FIG. 20, a connecting seal member 117 formed of a soft material is provided in the negative-pressure generating portion 102, and is connectable to the head side.

Eighth Embodiment

FIGS. 21 to 24 show another ink cartridge 200, and the point of difference between this ink cartridge in accordance with this eighth embodiment and the ink cartridge in accordance with the seventh embodiment lies in that the means for connecting a supply hole attachment 203 to an ink accommodating portion 201 is structured as a snap-fit type.

Namely, a pair of snap-fitting portions 205 projecting inwardly are formed in the vicinity of a seal portion 204 of the supply hole attachment 203 having a negative-pressure generating portion 202, and are made retainable at retaining walls 206 provided projectingly on the bottom portion of the ink accommodating portion 201.

Figure 22:
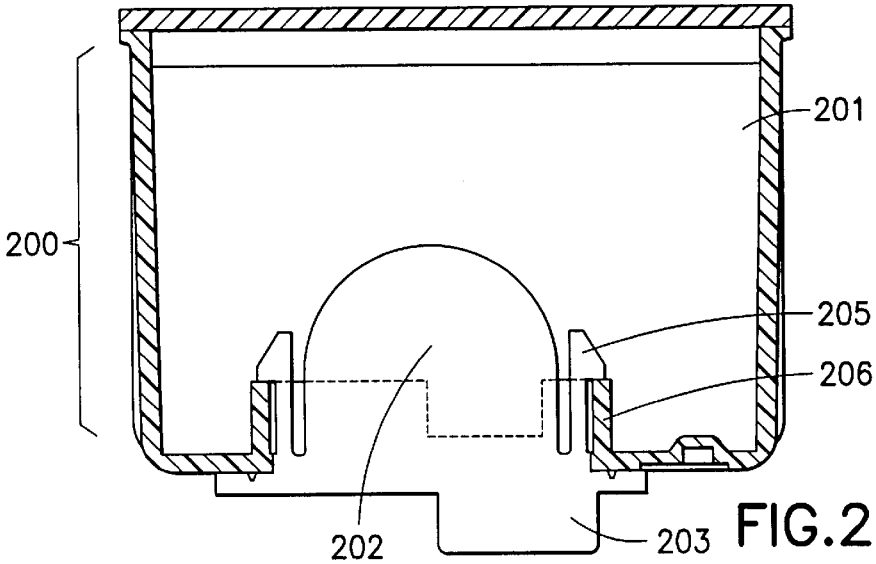
FIG. 22 is an explanatory diagram of an inverted state of FIG. 21.
Figure 23:
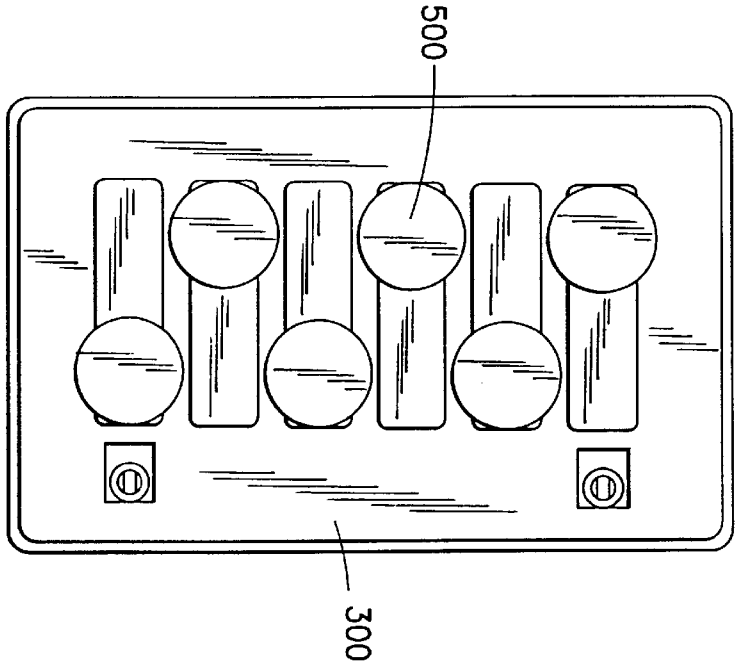
FIG. 23 is an explanatory diagram for attaching the supply hole attachment.
Figure 24:
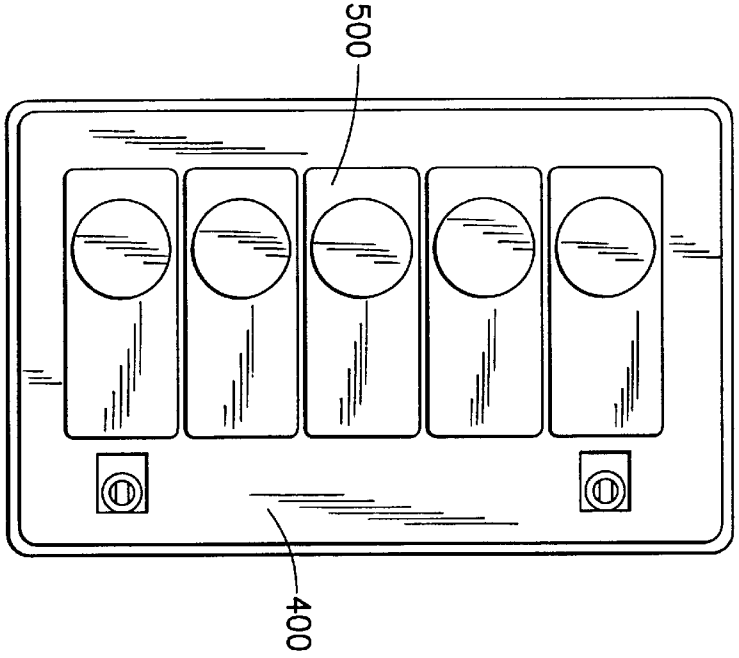
FIG. 24 is another explanatory diagram for attaching the supply hole attachment.

Accordingly, as shown in FIG. 22, the supply hole attachment 203 can be inverted and can be connected to the ink accommodating portion 201. Further, as shown in FIGS. 23 and 24, a plurality of supply hole attachments 500 can be used by being connected in arbitrary directions with respect to a multicolor ink cartridge 300 or 400, so that this arrangement is advantageous in practical use.

Ninth Embodiment

Figure 25:
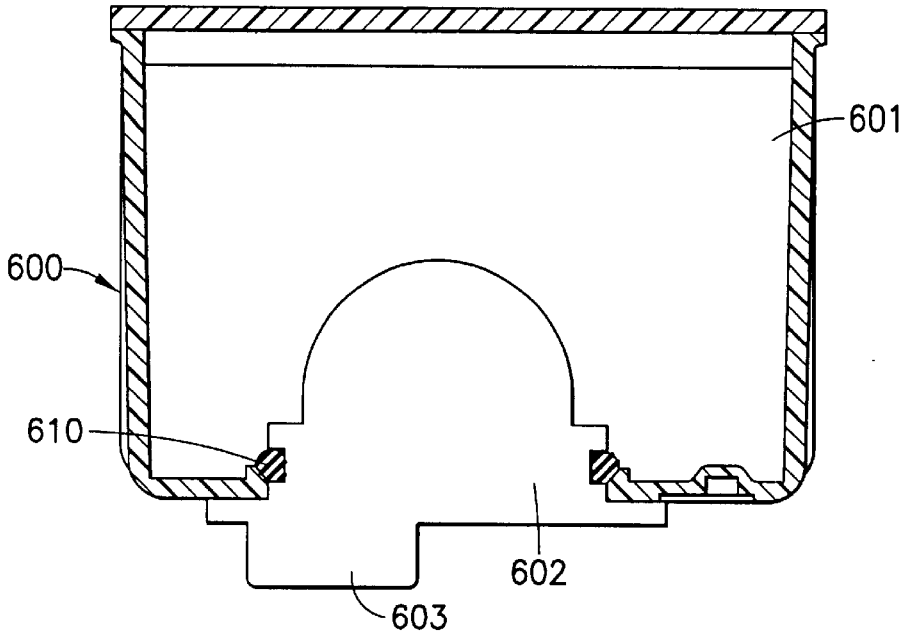
FIG. 25 is a vertical cross-sectional view of the ink cartridge in accordance with a ninth embodiment.

The characteristic feature of an ink cartridge 600 shown in FIG. 25 lies in the arrangement in which a supply hole attachment 603 having a negative-pressure generating portion 602, which is detachably fitted to the bottom portion of an ink accommodating portion 601, is connected by means of a resilient member 610 such as an O-ring so as make it possible to safely prevent the ink leakage.

It should be noted that although the O-ring is generally formed of rubber or a resin material, it is also possible to use, for example, water expansible rubber.

10th Embodiment

Figure 26:
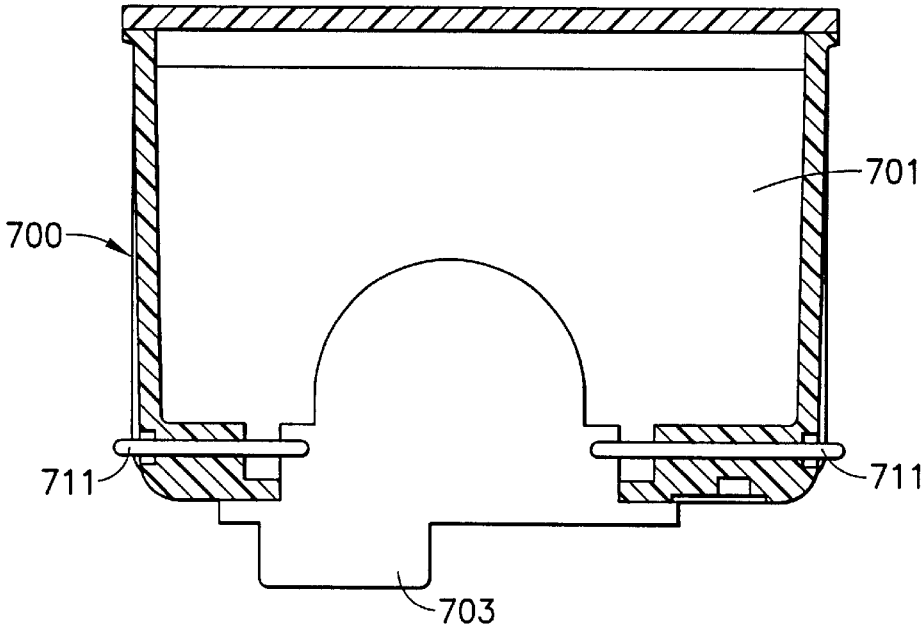
FIG. 26 is a vertical cross-sectional view of the ink cartridge in accordance with a 10th embodiment.

The characteristic point of an ink cartridge 700 shown in FIG. 26 lies in that a supply hole attachment 703 which is fitted to an ink accommodating portion 701 is connected by fixing pins 711 also serving as ink-end detecting pins, making it possible to electrically detect an ink end.

11th Embodiment

Figure 27:
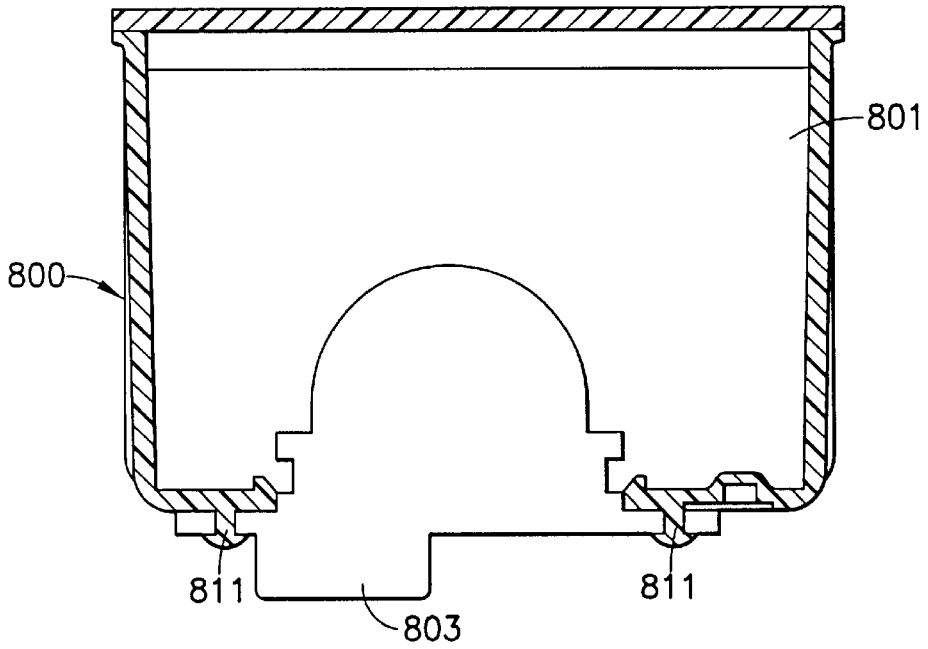
FIG. 27 is a vertical cross-sectional view of the ink cartridge in accordance with an 11th embodiment.

The characteristic point of an ink cartridge 800 shown in FIG. 27 lies in that a supply hole attachment 803 which is fitted to an ink accommodating portion 801 is connected by caulking and coupling members 811, making it possible to substantially simplify the process of its fitting.

12th Embodiment

Figure 28:
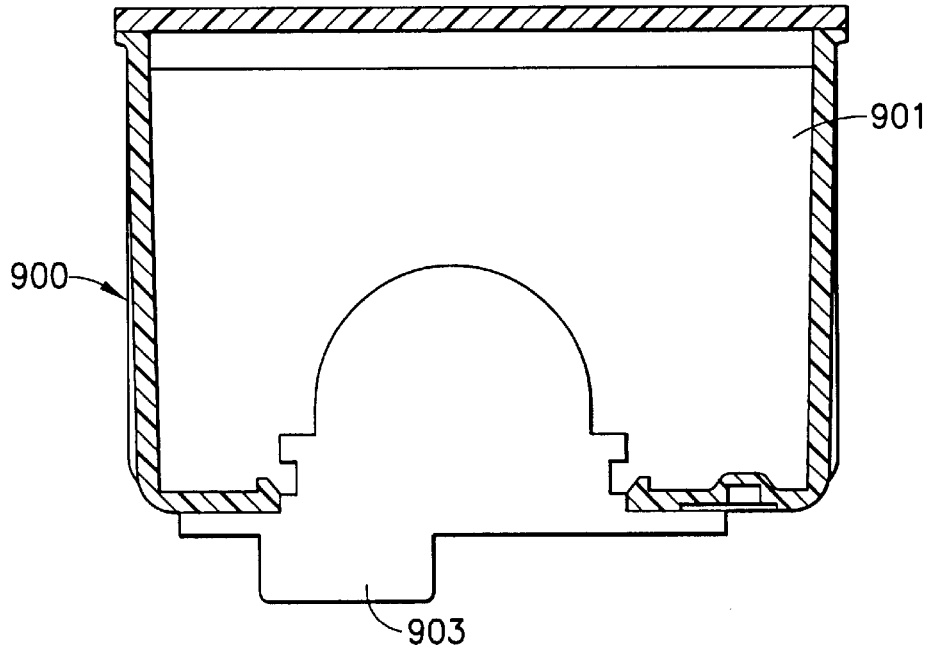
FIG. 28 is a vertical cross-sectional view of the ink cartridge in accordance with a 12th embodiment.

The characteristic point of an ink cartridge 900 shown in FIG. 28 lies in that a supply hole attachment 903 which is fitted to an ink accommodating portion 901 is connected by ultrasonic welding or vibrational welding, making it possible to obtain an ink cartridge which is free of ink leakage.

INDUSTRIAL APPLICABILITY

The advantages peculiar to the present invention are as follows:

1. Since the supply hole means can be replaceably connected to the ink accommodating means, the ink cartridge with a simple structure can be used over extended periods of time.

2. Since the supply hole attachment can be simply attached to or detached from the case, the regeneration and reuse of used cartridges are facilitated.

3. If a spare supply hole attachment is prepared in advance, the ink cartridge can be easily regenerated even by the user of the printer.

4. Since the ink cartridge can be regenerated and reused by simply replacing the supply hole attachment on the used ink cartridge, it is possible to attain a substantial reduction in cost.

5. It is possible to fill or refill a single-color or multicolor ink speedily into the ink cartridge.

6. Since the disassembly and reassembly of the ink cartridge are easy, its maintenance and inspection are facilitated.

7. It is possible to increase an amount of ink filled by the use of a seal member having a special cross-sectional shape.

8. By provision of ribs on the upper cover, it is possible to resultantly improve the sealing performance using the seal member.

9. The processing of ink refilling can be executed in a clean state.

10. The foam inside the used ink cartridge can be effectively cleaned can be cleaned effectively, and new ink can be filled smoothly.

11. Since ink can be supplied effectively by the negative-pressure generating means, it is possible to effect high-quality printing.

What is claimed:

1. An ink cartridge for detachable mounting on a connecting member of an ink jet recording apparatus, the connecting member reciprocating in a horizontal plane when the ink jet recording apparatus prints, said ink cartridge comprising:

an ink accommodating portion shaped to contain ink;

an ink supply hole disposed at a bottom of said ink accommodating portion; and a valve unit connected to the ink supply hole by a connecting portion and including a movable valve portion and a fixed valve portion, said movable valve portion being oriented such that a flow of ink is regulated by motion of said movable valve portion along a line lying in a plane that is parallel to the horizontal plane.

2. The ink cartridge of claim 1, the valve unit further including a main portion and an auxiliary portion, said movable valve portion being disposed on said main portion and said fixed valve portion being disposed on said auxiliary portion, wherein said auxiliary portion is selectively detachable from said main portion.

3. The ink cartridge of claim 1, further comprising:

a supply hole attachment disposed at said bottom of said ink accommodating portion, said supply hole being defined in said supply hole attachment, wherein said supply hole attachment is selectively detachable from said bottom of said ink accommodating portion.

4. The ink cartridge of claim 3, further comprising a packing member disposed in said supply hole attachment.

5. The ink cartridge of claim 3, further comprising a seal member dimensioned and disposed on said supply hole attachment to block said supply hole.

6. The ink cartridge of claim 1, further comprising a packing member disposed in said ink supply hole.

7. The ink cartridge of claim 1, further comprising a porous member disposed in said ink accommodating portion.

8. The ink cartridge of claim 1, wherein said ink supply hole lies in a horizontal plane.

9. An ink cartridge for detachable mounting on a connecting member of an ink jet recording apparatus, said ink cartridge comprising:

an ink accommodating portion shaped to contain ink, said ink accommodating portion including a frame member having a first open end and a second open end, an upper cover member, and a lower cover member, wherein said lower cover member is detachably disposed at said first open end and said upper cover member is detachably disposed at said second open end;

an ink supply hole disposed at a bottom of said ink accommodating portion; and a valve unit connected to the ink supply hole by a connecting portion and including a movable valve portion and a fixed valve portion, said movable valve portion being oriented such that a flow of ink is regulated by a horizontal motion of said movable valve portion.

10. The ink cartridge of claim 9, wherein the frame member has a plurality of engaging projections, and further comprising:

a plurality of upper cover engaging legs disposed on said upper cover; and a plurality of lower cover engaging legs disposed on said lower cover;

wherein said upper cover engaging legs and said lower cover engaging legs are shaped to engage the plurality of engaging projections.

11. An ink cartridge for operation in a recording apparatus, the recording apparatus having an ink leading out tool for supplying ink to a recording unit through the ink leading out tool, said ink cartridge comprising:

an ink accommodating portion shaped to contain ink;

an ink supply hole disposed at a bottom of said ink accommodating portion, said ink supply hole lying in a horizontal plane;

a valve unit connected to the ink supply hole by a connecting portion and including a movable valve portion and a fixed valve portion, said movable valve portion being oriented such that a flow of ink is regulated by a horizontal motion of said movable valve; and a supply hole attachment disposed at said bottom of said ink accommodating portion, said supply hole being defined in said supply hole attachment, wherein said supply hole attachment is selectively detachable from said bottom of said ink accommodating portion;

a seal disposed at an outside end of said supply hole attachment, the seal constructed to permit the ink leading out tool to enter said outside end, said supply hole attachment being detachably fitted to said ink accommodating portion, said supply hole attachment having an inner portion comprising a resilient material dimensioned and disposed so that said supply hole attachment couples to the ink leading out tool in an ink-tight manner.

12. An ink cartridge for detachable mounting on a connecting member of an ink jet recording apparatus, the connecting member reciprocating in a horizontal plane when the ink jet recording apparatus prints, said ink cartridge comprising:

an ink accommodating portion shaped to contain ink;

an ink supply hole disposed at a bottom of said ink accommodating portion;

a film located within and dividing the ink accommodating portion to define at least part of a chamber within the ink accommodating portion; and a valve unit connected to the ink supply hole by a connecting portion and including a movable valve portion and a fixed valve portion, said movable valve portion being oriented such that a flow of ink is regulated by motion of said movable valve portion along a line lying in a plane that is parallel to the horizontal plane.

13. The ink cartridge of claim 12, the valve unit further including a main portion and an auxiliary portion, said movable valve portion being disposed on said main portion and said fixed valve portion being disposed on said auxiliary portion, wherein said auxiliary portion is selectively detachable from said main portion.

14. The ink cartridge of claim 12, further comprising:

a supply hole attachment disposed at said bottom of said ink accommodating portion, said supply hole being defined in said supply hole attachment, wherein said supply hole attachment is selectively detachable from said bottom of said ink accommodating portion.

15. The ink cartridge of claim 14, further comprising a packing member disposed in said supply hole attachment.

16. The ink cartridge of claim 14, further comprising a seal member dimensioned and disposed on said supply hole attachment to block said supply hole.

17. The ink cartridge of claim 12, further comprising a packing member disposed in said ink supply hole.

18. The ink cartridge of claim 12, further comprising a porous member disposed in said ink accommodating portion.

19. The ink cartridge of claim 12, said ink accommodating portion including a frame member having a first open end and a second open end, an upper cover member, and a lower cover member;

wherein said lower cover member is detachably disposed at said first open end and said upper cover member is detachably disposed at said second open end.

20. The ink cartridge of claim 19, wherein the frame member has a plurality of engaging projections, and further comprising:

a plurality of upper cover engaging legs disposed on said upper cover; and a plurality of lower cover engaging legs disposed on said lower cover;

wherein said upper cover engaging legs and said lower cover engaging legs are shaped to engage the plurality of engaging projections.

21. The ink cartridge of claim 12, wherein said ink supply hole lies in a horizontal plane.

22. An ink cartridge for detachable mounting on a connecting member of an ink jet recording apparatus, said ink cartridge comprising:

an ink accommodating portion shaped to contain ink;

an ink supply hole disposed at a bottom of said ink accommodating portion;

a film defining at least part of a valve chamber of the ink accommodating portion; and a valve unit, connected to the ink supply hole by a connecting portion and including a movable valve portion and a fixed valve portion, the movable valve portion being arranged for reciprocable motion alone a line that lies in a horizontal plane into and out of contact with the fixed valve portion.

23. An ink cartridge as in claim 22, wherein said film is located within and divides the ink accommodating portion.

24. An ink cartridge for detachable mounting on a connecting member of an ink jet recording apparatus for fluid-communication between the ink cartridge and a recording head reciprocating in a horizontal plane when the recording head prints, said ink cartridge comprising:

an ink accommodating portion shaped to contain ink;

an ink supply hole disposed at a bottom of said ink accommodating portion; and a valve unit connected to the ink supply hole by a connecting portion and including a movable valve portion and a fixed valve portion, said movable valve portion being oriented such that a flow of ink is regulated by a horizontal motion of said movable valve portion.

25. An ink cartridge for detachable mounting on a connecting member of an ink jet recording apparatus, said ink cartridge comprising:

an ink accommodating portion shaped to contain ink;

an ink supply hole disposed at a bottom of said ink accommodating portion, and adapted to receive the connecting member by inserting the connecting member into the ink supply hole in an insertion direction; and a valve unit connected to the ink supply hole by a connecting portion and including a movable valve portion and a fixed valve portion, said movable valve portion being oriented such that a flow of ink is regulated by a horizontal motion of said movable valve portion along a direction perpendicular to the insertion direction.

26. An ink cartridge for detachable mounting on a connecting member of an ink jet recording apparatus for fluid-communication between the ink cartridge and a recording head reciprocating in a horizontal plane when the recording head prints, said ink cartridge comprising:

an ink accommodating portion shaped to contain ink;

an ink supply hole disposed at a bottom of said ink accommodating portion;

a film defining at least part of a chamber within the ink accommodating portion; and a valve unit, disposed in the chamber, connected to the ink supply hole by a connecting portion, and including a movable valve portion and a fixed valve portion, said movable valve portion being oriented such that a flow of ink is regulated by a horizontal motion of said movable valve portion.

27. An ink cartridge for detachable mounting on a connecting member of an ink jet recording apparatus, said ink cartridge comprising:

an ink accommodating portion shaped to contain ink;

an ink supply hole disposed at a bottom of said ink accommodating portion, and adapted to receive the connecting member by inserting the connecting member into the ink supply hole in an insertion direction;

a film defining at least part of a chamber within the ink accommodating portion; and a valve unit, disposed in the chamber, connected to the ink supply hole by a connecting portion, and including a movable valve portion and a fixed valve portion, said movable valve portion being oriented such that a flow of ink is regulated by a horizontal motion of said movable valve portion along a direction perpendicular to the insertion direction.

* * * * *

UNITED STATES PATENT AND TRADEMARK OFFICE

CERTIFICATE OF CORRECTION

PATENT NO. : 6,666,551 B2 
DATED : December 23, 2003
INVENTOR(S) : Takao Kobayashi and Hisashi Miyazawa It is certified that error appears in the above-identified patent and that said Letters Patent is hereby corrected as shown below:

Title page,
Item [30], Foreign Application Priority Data, add the following additional priority applications:
-- February 21, 1996 (JP) …….. P. Hei 8-57052
March 22, 1996 (JP) …….. P. Hei 8-93587 --.

Signed and Sealed this

Twenty-fifth Day of May, 2004

JON W. DUDAS
*Acting Director of the United States Patent and Trademark Office*